United States Patent [19]

Takano et al.

[11] Patent Number: 5,053,814

[45] Date of Patent: Oct. 1, 1991

[54] IMAGE FORMING APPARATUS

[75] Inventors: Yoshiaki Takano; Masazumi Ito; Keiji Kusumoto; Takashi Noda; Masaaki Oyabu, all of Osaka, Japan

[73] Assignee: Minolta Camera Kubushiki Kaisha, Osaka, Japan

[21] Appl. No.: 137,374

[22] Filed: Dec. 23, 1987

[30] Foreign Application Priority Data

| | | | |
|---|---|---|---|
| Dec. 24, 1986 | [JP] | Japan | 61-310525 |
| Dec. 24, 1986 | [JP] | Japan | 61-310526 |
| Dec. 24, 1986 | [JP] | Japan | 61-310527 |
| Dec. 24, 1986 | [JP] | Japan | 61-310528 |
| Dec. 24, 1986 | [JP] | Japan | 61-310529 |

[51] Int. Cl.[5] ..... G03G 21/00

[52] U.S. Cl. ..... 355/208; 271/265; 355/309; 355/311

[58] Field of Search ..... 355/14 SH, 3 SH, 14 CU, 355/14 R, 6, 308, 309, 209, 68, 208, 311; 271/258, 259, 265, 171, 127; 340/675; 354/21, 275

[56] References Cited

U.S. PATENT DOCUMENTS

| | | | |
|---|---|---|---|
| 3,700,323 | 10/1972 | Guyette et al. | 355/14 R X |
| 4,211,482 | 7/1980 | Arai et al. | 355/8 |
| 4,248,528 | 2/1981 | Sahay | 271/258 X |
| 4,252,433 | 2/1981 | Sullivan | 355/15 |
| 4,367,944 | 1/1983 | Kuru | 355/6 X |
| 4,500,183 | 2/1985 | Tanikawa | 354/21 |
| 4,719,489 | 1/1988 | Ohkubo et al. | 355/3 SHX |
| 4,739,370 | 4/1988 | Yoshida et al. | 355/15 |
| 4,757,348 | 7/1988 | Rourke et al. | 355/14 R X |
| 4,782,365 | 11/1988 | Takagi | 355/68 X |

FOREIGN PATENT DOCUMENTS

| | | | |
|---|---|---|---|
| 0060349 | 4/1982 | Japan | 355/8 |
| 0064445 | 4/1984 | Japan | 271/3.1 |
| 0027574 | 2/1985 | Japan . | |
| 0242477 | 12/1985 | Japan | 355/14 SH |
| 0262737 | 12/1985 | Japan | 271/265 |
| 0028961 | 2/1986 | Japan | 355/14 TR |
| 0094070 | 5/1986 | Japan | 355/3 R |

*Primary Examiner*—A. T. Grimley
*Assistant Examiner*—Robert Beatty
*Attorney, Agent, or Firm*—Burns, Doane, Swecker & Mathis

[57] ABSTRACT

An image forming apparatus includes various image forming units and a detachable paper cassette with data on its outer surface as to thickness, talc content, quality and the type of copy paper; the image forming units being controlled in accordance with the data when the cassette is changed. The apparatus also includes a device for marking a mark corresponding to the number of sheets of the copy paper used so as to detect the number of sheets remaining in the cassette.

27 Claims, 12 Drawing Sheets

IMAGE FORMING APPARATUS

BACKGROUND OF THE INVENTION

The present invention relates to an image forming apparatus for use with a paper cassette containing copy paper and removably attached to the main body of the apparatus for feeding the paper to the apparatus. Typical of such apparatus is a copying machine.

A paper cassette serving also as a storage case is disclosed in Unexamined Japanese Utility Model Application SHO 61-56335. Further various copy papers are in use which differ in size, thickness, talc content, quality, etc. To obtain copy or like images of improved quality, it is desired to form the image under conditions in conformity with these characteristics of copy paper.

The paper cassette serving also as a storage case initially contains a predetermined number of copy sheets. However, since the cassette is closed, it is difficult for the user to readily recognize the number of remaining sheets during use. To detect the number of sheets remaining in the cassette, means is conventionally used for detecting the thickness of stack of the sheets therein, but such means has the problem that since the thickness of copy paper is not uniform, the detected thickness does not always indicate the accurate number of remaining sheets. The detecting means, which comprises a plurality of sensors or a pulse disk, has another problem in that it is complex in construction and costly.

SUMMARY OF THE INVENTION

A first object of the present invention is to provide an image forming apparatus which is adapted to form images under conditions suited to the characteristics, such as thickness, talc content and quality, of the copy paper contained in a paper cassette so as to obtain images of improved quality while precluding trouble during the formation of images.

To fulfill this object, the present invention provides an image forming apparatus which comprises a paper cassette marked on its outer surface with data indicating the characteristics of the copy paper contained therein, means provided in the main body of the apparatus for reading the data, means for forming an image on the copy paper and means for controlling the image forming means according to the data obtained by the reading means so that images can be formed under proper conditions.

A second object of the invention is to provide an image forming apparatus which is adapted to readily and accurately indicate the number of copy sheets remaining in the paper cassette although it is difficult to recognize the number from outside, the apparatus having means of simple construction therefor.

To fulfill this object, the apparatus of the invention is provided in its main body with marking means for making a mark on the outer surface of the paper cassette according to the number of copy sheets used and with means for reading the mark so as to readily and accurately indicate the number of remaining copy sheets with reference to the mark.

Other objects and features of the invention will become apparent from the following description with reference to the accompanying drawings.

DETAILED DESCRIPTION OF THE INVENTION

A copying machine embodying the invention will be described below with reference to the drawings.

Figure 9:
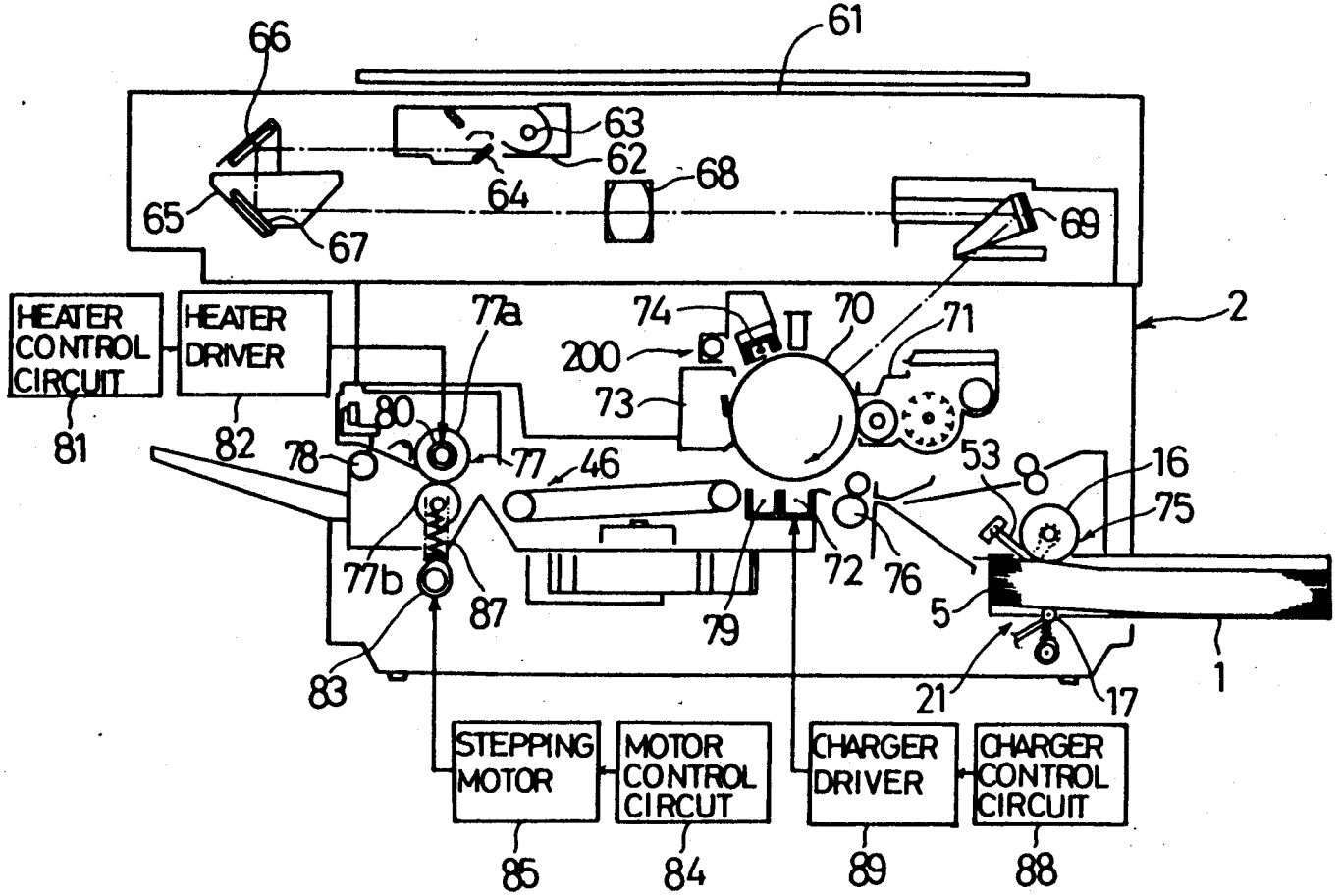
FIG. 9 is a sectional view showing the apparatus in its entirety.

The copying machine, which is shown in FIG. 9, comprises a paper cassette 1 and the main body 2 of the machine. The cassette 1 is removably installed in the main body 2.

Figure 1:
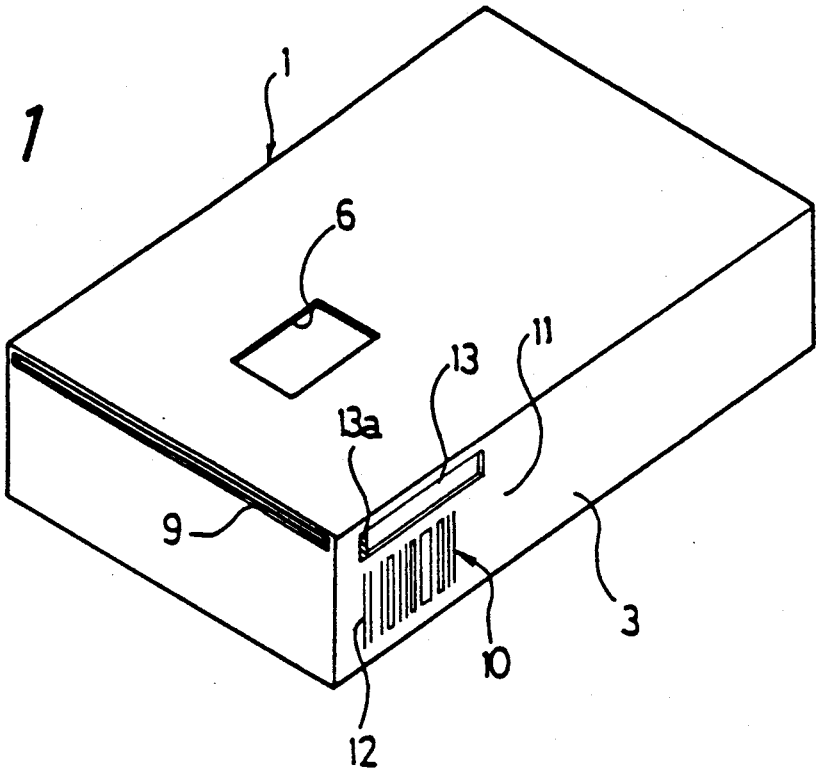
FIG. 1 is a perspective view showing a paper cassette embodying the invention, with a protective cover removed therefrom.
Figure 2:
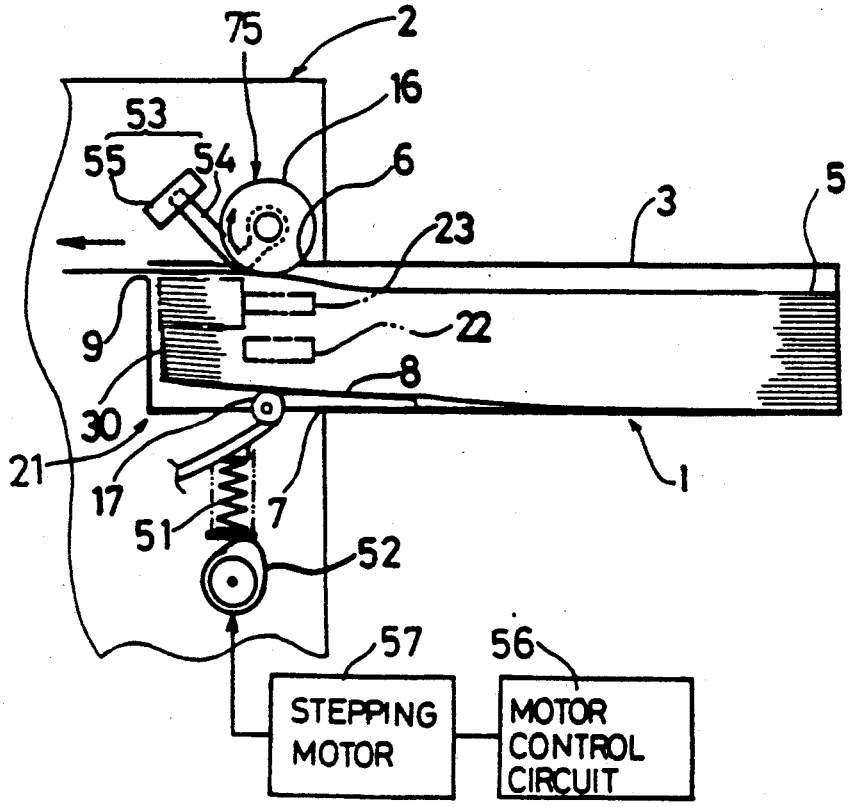
FIG. 2 is a sectional view showing the cassette as inserted in the main body of an apparatus.
Figure 3:
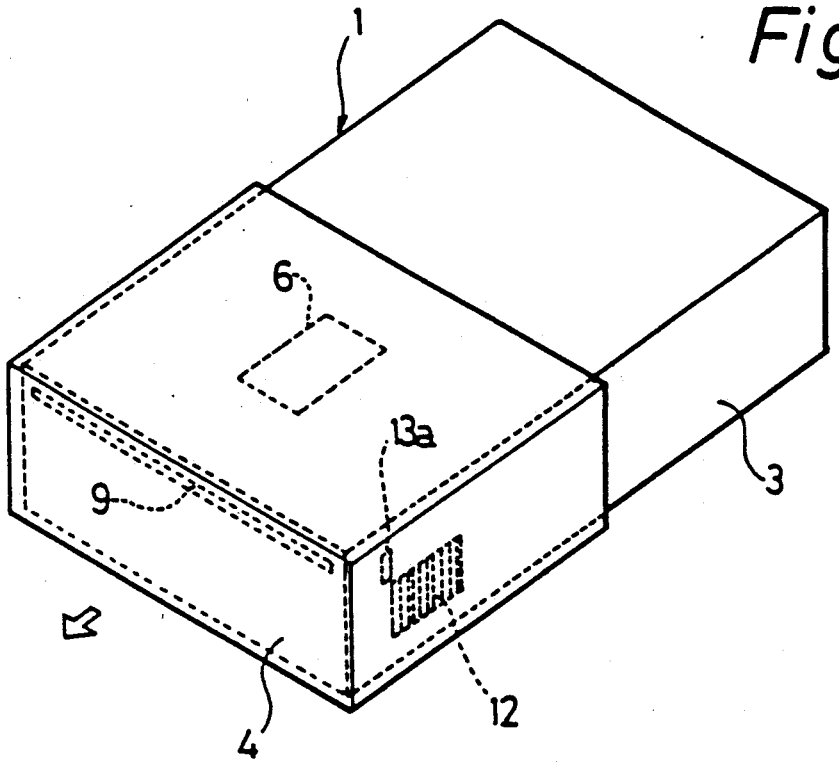
FIG. 3 is a perspective view showing the cassette with the protective cover attached thereto.

FIGS. 1 to 3 show the paper cassette 1. FIG. 3 shows the cassette 1 before use. The interior of the body 3 of the cassette is held moistureproof by a protective cover 4. The cassette body 3 contains a predetermined number of paper sheets (copy paper) 5. The cassette body 3 is formed with a feed roller opening 6 in a top front portion thereof and with a pushing-up roller opening 7 in a bottom front portion thereof. A pushing-up plate 8 is disposed above the opening 7. The cassette body 3 is further formed at the upper end of its front side with a paper feed slit 9 through which paper sheets 5 are fed one by one.

The cassette body 3 is in the form of a closed box and is so constructed that it can not be supplemented with paper 5 by the user. The protective cover 4 seals off the openings 6, 7 and the slit 9, holding the interior of the cassette 1 moistureproof.

The front end portion, i.e. insertion portion 10, of the cassette body 3 bears a bar code (data indicating means) 12 printed on one side surface 11 thereof and indicating various items of data as to the paper 5. More specifically, the bar code 12 represents the characteristics of the paper 5, such as size, thickness, talc content and quality (coefficient of friction and electric resistance) and also indicates the number of sheets 5 initially contained in the cassette. A black bar mark, i.e. dummy bar 13*a*, for initial position setting is printed on the side surface 11 above the bar code 12. To the rear of the dummy bar 13*a*, the side surface 11 has a blank portion to be marked with a black bar (bar mark) 13 indicating the number of sheets used. The bar code 12, the dummy bar 13*a* and the black bar 13 are protected with the protective cover 4 when the cassette is not in use.

Figure 4:
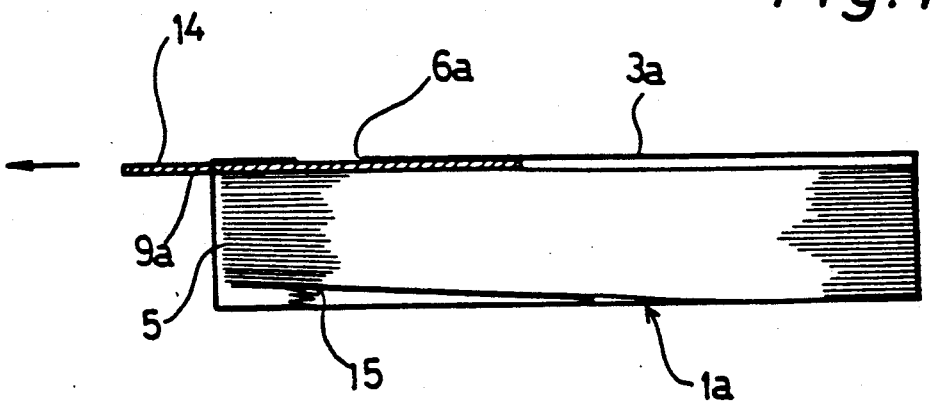
FIG. 4 is a sectional view showing another paper cassette.

The paper cassette 1 serving also as a storage case can be of various constructions. For example, a cassette is usable which has incorporated in its body a spring for biasing the pushing-up plate. FIG. 4 shows a paper cassette 1*a* of the type having a pushing-up spring 15 therein and a seal plate 14 in place of the protective cover 4. The body 3*a* of the cassette 1*a* has a feed roller opening 6*a* and a feed slit 9*a*, which are closed with the seal plate 14 for sealing off the interior of the body 3*a* against moisture. When the cassette is to be used, the seal plate 14 is withdrawn for the paper 5 to be sent out through the slit 9*a*. Although not shown, the insertion portion of the cassette 1*a*, i.e. the front end portion of one side of the cassette body 3*a*, is externally marked with a bar code and dummy bar like the cassette 1 shown in FIGS. 1 to 3.

As shown in FIGS. 2 and 9, the paper cassette 1 of FIGS. 1 to 3 is used as removably inserted in the main body 2 of the apparatus, with the protective cover 4 removed. At this time, a feed roller 16 of feed means 75 is positioned inside the cassette body 3 through the opening 6 and is in pressing contact with the top of stack of the paper 5. A pushing-up roller 17 is also positioned inside the cassette body 3 through the opening 7 and biased into contact with the lower surface of the plate 8, holding the plate 8 in a lifted position. The pushing-up roller 17 is so biased by a spring 51, the pressure of which is adjustable by a feed pressure control cam 52. By the action of the cam 52 which is controlled by a motor control circuit 56 and a stepping motor 57, the paper feed pressure between the feed roller 16 and the paper 5 can be set to a value suited to the quality, especially the coefficient of friction, of the paper 5. Stated more specifically, if the paper 5 has a small coefficient of friction, the feed pressure is set to a high value to ensure proper feeding, while when the paper 5 has a great coefficient of friction, the pressure is set to a low value so that the paper 5 will not be subjected to an excessive external force. Sheets of paper 5 are fed one by one to the main body 2 of the apparatus by the rotation of the feed roller 16.

Indicated at 53 in FIG. 2 is paper absence detecting means comprising an absence detecting lever 54 and a photosensor 55 of the light transmission type. When the paper 5 within the cassette 1 has been wholly used, the forward end of the lever 54 pivots about the axis of the feed roller 16 to move out from the light-receiving region of the photosensor 55, which therefore detects the absence of paper.

Figure 5:
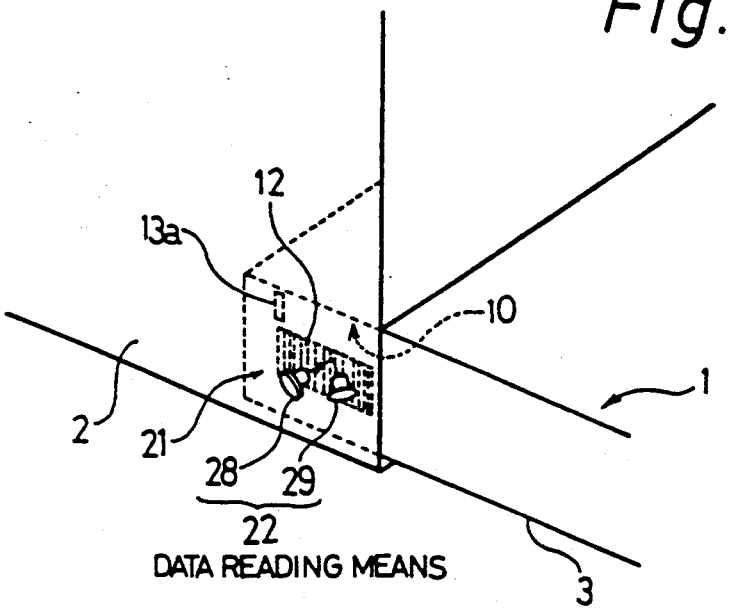
FIG. 5 is a perspective view showing data reading means.
Figure 6:
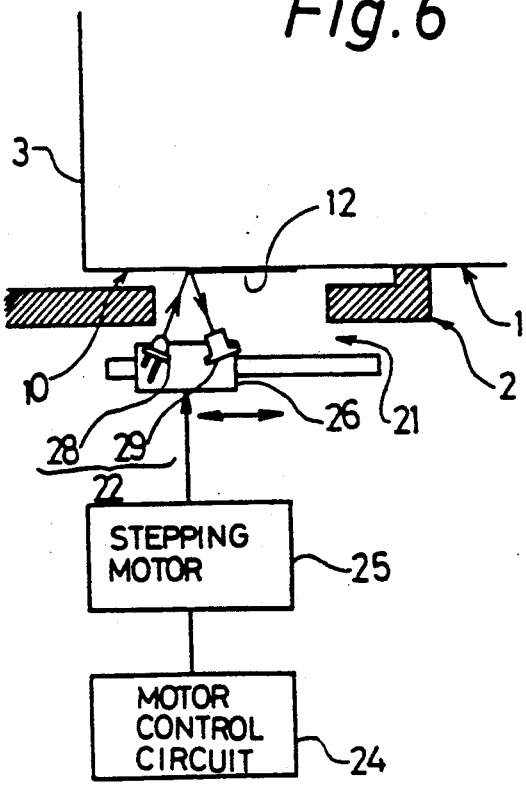
FIG. 6 is a plan view showing data reading means of the scanning type.

With reference to FIGS. 2, 5 and 6, the main body 2 has a cassette receiving portion 21, which is provided with means (data reading means) 22 for reading the bar code 12. The code reading means 22 of the present embodiment comprises a light projector 28 comprising an LED, and a photosensor 29 for detecting the light emitted by the projector 28 and reflected from the bar code 12. The code reading means 22 can be made movable in the directions of arrows shown in FIG. 6 so as to scan the entire data of the bar code. Thus, the projector 28 and the photosensor 29 are mounted on a carriage 26 which is controllable by a motor control circuit 24 and drivingly movable by a stepping motor 25.

Figure 7:
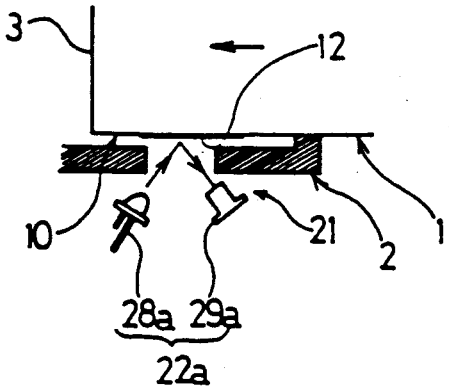
FIG. 7 is a plan view showing data reading means of the stationary type.

While the code reading means 22 itself is movable for scanning, FIG. 7 shows a code reading means 22*a* of the stationary type used in the present embodiment and comprising a light projector 28*a* and a photosensor 29*a* which are both fixed. This means 22*a* is adapted to read all data of the bar code 12 when the cassette 1 is inserted into the main body 2, utilizing the insertion movement.

Black bar reading means (mark reading means) 23 having the same construction as the code reading means 22 is disposed above and close to the reading means 22 (FIG. 2). The black bar reading means 23 is coupled to the black bar marking means (marking means) 30 to be described later and is movable for scanning to detect the length of the black bar (bar mark) 13.

Figure 8:
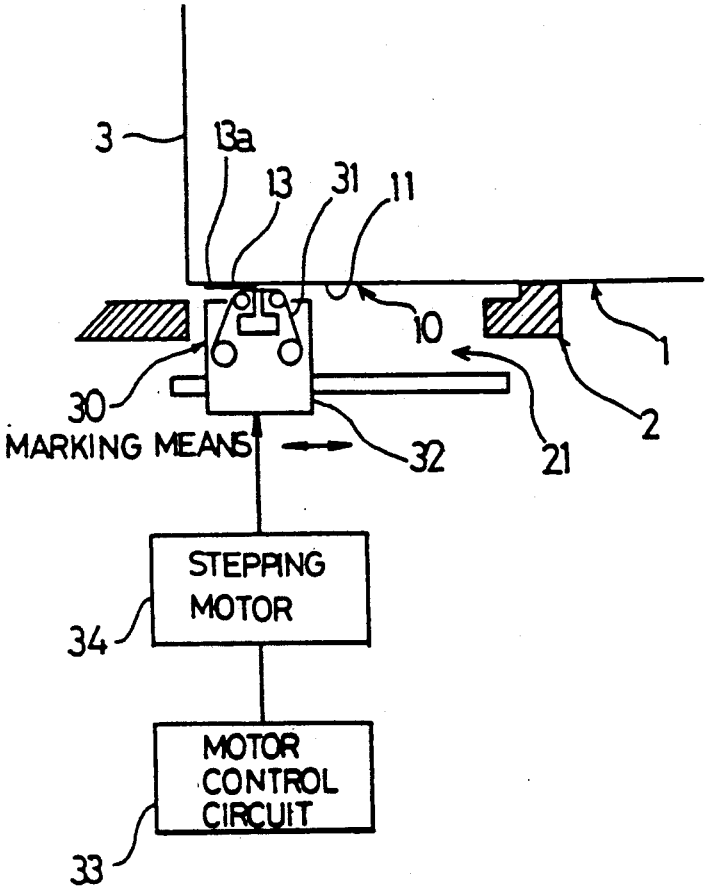
FIG. 8 is a plan view showing marking means.

The black bar 13 is marked on the side surface 11 of the insertion portion 10 of the cassette 1 in accordance with the number of paper sheets used, the length of the bar 13 being in proportion to the number of used paper sheets. FIG. 8 shows means 30 of the heat transfer type for marking the black bar 13. The marking means 30 has a printing head 32 provided with an ink ribbon 31 and drivingly movable in the directions of arrows shown by a stepping motor 34 which is controlled by a motor control circuit 33. The black bar reading means 23 detects the position of the rear end of the black bar 13 and emits a rear end detection signal. Based on this signal, the printing head 32 moves to the rear end position and then marks a length of bar portion, as added to the bar 13, corresponding to the number of sheets used.

While the black bar marking means 30 is an example of means for writing data as to the number of sheets used on the outer surface of the cassette 1, other marking means as of dot type, exposure type or the like is usable. It is also possible to indicate the data by display means other than the black bar. The bar 13 is initially marked continuously with the dummy bar 13*a* upon detecting the position of the rear end of the dummy bar 13*a*.

Basically, the main body 2 of the copying machine has a common construction wherein an image of a document sheet is copied on the paper 5 fed from the cassette 1. With reference to FIG. 9, indicated at 61 is a document support table, at 62 a first carriage serving as a scanner and carrying a light source 63 and a first mirror 64, and at 65 a second carriage equipped with second and third mirrors 66, 67. The first carriage 62 moves along the support table 61 therebelow for scanning the document. The second carriage 65 moves with the first carriage 62 by one-half the distance of travel of the first carriage 62 so as to maintain the optical path at a constant length despite the scanning movement. Indicated at 68 is a projecting lens, at 69 a fourth mirror, and at 70 a photosensitive member rotatable in the direction of arrow shown and to be exposed to the image of the document on the support table 61. Arranged around the photosensitive member 70 are a developing unit 71, transfer charger 72, separating charger 79, cleaner 73 and sensitizing charger 74. Indicated at 75 is the aforementioned feed means, at 46 a paper conveyor, at 76 a register roller, at 77 fixing means and at 78 a discharge roller.

As already described, the feed means 75 is adapted to give an adjustable paper feed pressure. The fixing means 77 comprises a pair of upper and lower fixing rollers 77*a*, 77*b*. The upper fixing roller 77*a* has a heater 80 incorporated therein, while the lower fixing roller 77*b* is biased upward by a spring 87 to give a fixing pressure. The power supply to the fixing heater 80 is controlled by a heater control circuit 81 and a heater driver 82 so that the power supply can be made greater when the paper 5 has a large thickness than when it has a small thickness. The pressure of the spring 87 is adjusted by a fixing pressure adjusting cam 83. By the action of the cam 83 which is controlled by a motor control circuit 84 and a stepping motor 85, the fixing pressure between the pair of rollers 77a, 77b can be set to a lower level when the paper 5 has a large thickness than when it has a small thickness.

The output of the transfer charger 72 is controlled by a charger control circuit 88 and a charger driver 89 so as to be greater when the paper 5 has a large thickness or high electric resistance than when it has a small thickness or low electric resistance, whereby the toner image on the photosensitive member 70 can be transferred to the paper 5 satisfactorily.

Figure 10:
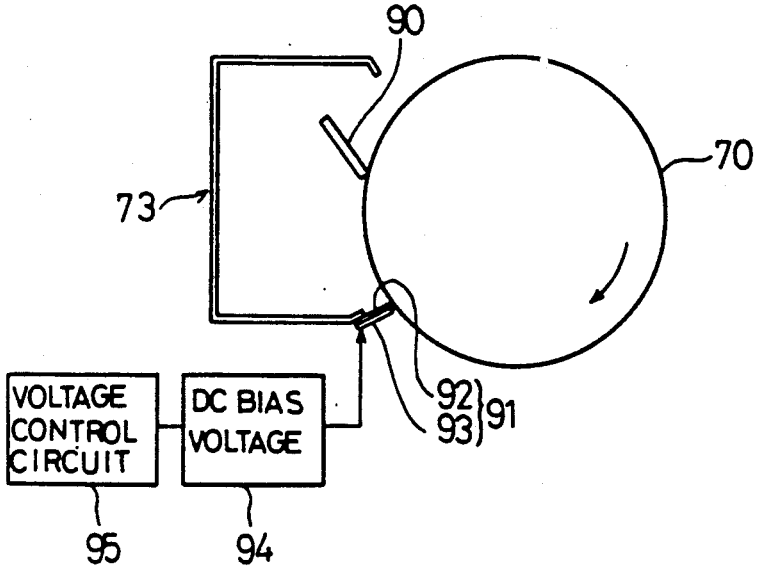
FIG. 10 is a sectional view showing a cleaner.

As seen in FIG. 10, the cleaner 73 includes a blade 90 and a toner confining member 91 for preventing spillage of toner. The confining member 91 comprises an insulating film 92 and an electrically conductive film 93 laminated to the film 92. A d.c. bias voltage 94 is applied to the conductive film 93 and is controlled by a voltage control circuit 95. When the paper 5 has a high talc content, the d.c. bias voltage 94 is raised to cause the paper particles on the photosensitive member 70 to adhere to the conductive film 93, thereby preventing the talc in the paper particles from reaching the blade 90.

The optical system including the light source 63, mirrors and lens 68, the image forming system including the photosensitive member 70 and developing unit 71, the feed means 75, the paper conveyor 46, the fixing means 77, etc. constitute means 200 for forming images on sheets of paper 5.

Figure 11:
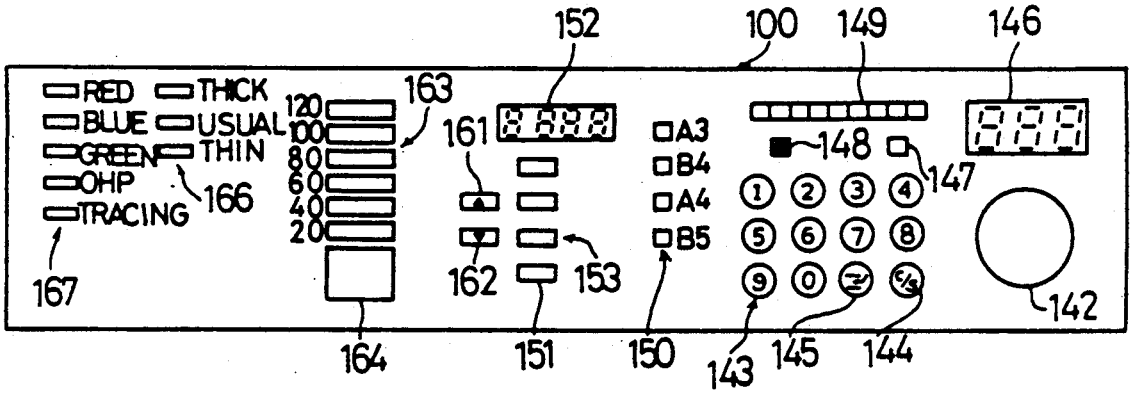
FIG. 11 is a plan view showing an operation panel.

FIG. 11 shows an operation panel 100 provided on a front upper portion of the main body 2. The operation panel 100 has a print key 142 for initiating the apparatus into a copying operation. The print key 142 has incorporated therein a liquid crystal display for showing a paper absence mark, jam/trouble mark, toner absence mark, etc. Arranged beside the print key 142 is a group of keys including ten number entry keys 143 for setting the number of copies to be made, a clear/stop key 144 for clearing the copy number setting or discontinuing copying operation, and an interrupt key 145 for interruption copying.

A copy number display 146 disposed above the print key 142 shows the number of copies entered by number entry keys 143. The number on display is decremented by 1 every time a copying cycle is made. The initial setting is restored on completion of copying operation. Arranged beside the display 146 are copy density adjusting keys 147, 148 and a copy density display 149. The key 147, when depressed, gives a higher density, while the depression of the key 148 affords a lower density.

A paper size display 150 is disposed at the left side of the group of number entry keys 143 for indicating the size of paper 5 in the cassette 1.

Arranged beside the paper side display 150 are a magnification selection key 151, a magnification data display 152 and a display 153 for showing a specific magnification in connection with the document size and the copy size.

Provided beside the magnification arrangement are an input data up key (up input means) 161 and a down key (down input means) 162. Further disposed beside these keys 161 and 162 are an arrangement of remaining paper display lamps (means for indicating the number of remaining sheets) 163 and an absence alarm lamp 164. For example, when 65 sheets remain in the cassette, a lamp marked with 60 goes on. When the number of remaining sheets decreases to 19 or smaller, the alarm lamp 164 goes on.

Thickness display lamps 166 and special paper display lamps 167 are arranged at the left portion of the operation panel. One of the thickness display lamps 166 goes on to indicate that the paper 5 is thick paper, usual paper or thin paper. When the paper 5 is red paper, blue paper, green paper, OHP paper or tracing paper, the corresponding one of the special paper display lamps 167 is turned on.

Figure 12:
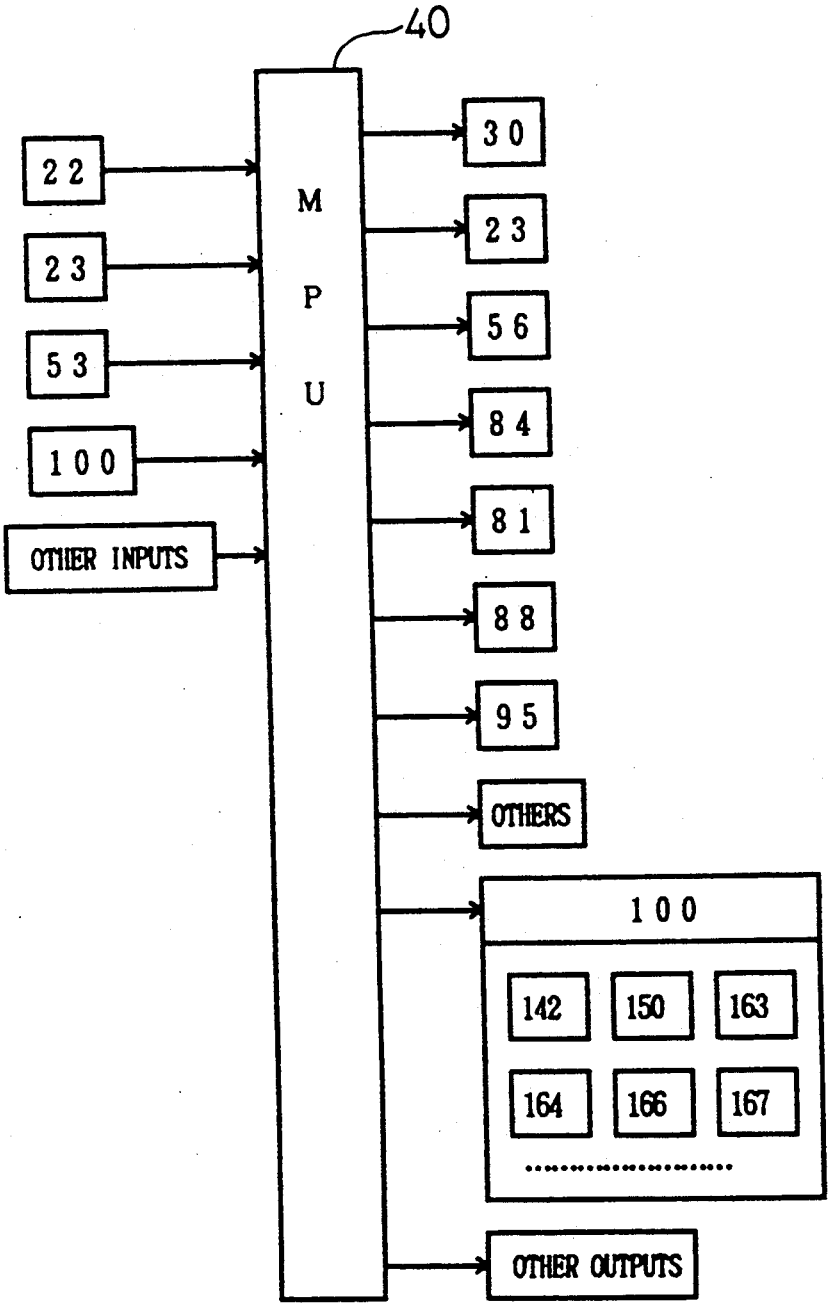
FIG. 12 is a block diagram showing a microcomputer control system for the apparatus.

FIG. 12 is a diagram showing the construction of a microcomputer for controlling the main body 2. A microprocessor unit (hereinafter referred to as "MPU") 40 receives a bar code signal from the code reading means 22, a black bar rear end detection signal from the black bar reading means 23, a signal from the paper absence detecting means 53, signals from the switches or keys on the operation panel 100 and signals from other sensors.

On the other hand, the MPU 40 feeds control signals to the black bar marking means 30, black bar reading means 23, motor control circuits 56, 84, heater control circuit 81, charger control circuit 88, voltage control circuit 95, etc. Other components of the image forming means 200 are also controlled by the MPU 40. The MPU 40 also feeds the required signals to the liquid display of the print key 142, paper size display 150, remaining paper display lamps 163, absence alarm lamp 164, thickness display lamps 166, special paper display lamps 167, etc.

The apparatus main body 2 is controlled according to a program stored in a memory of MPU 40.

Figure 13:
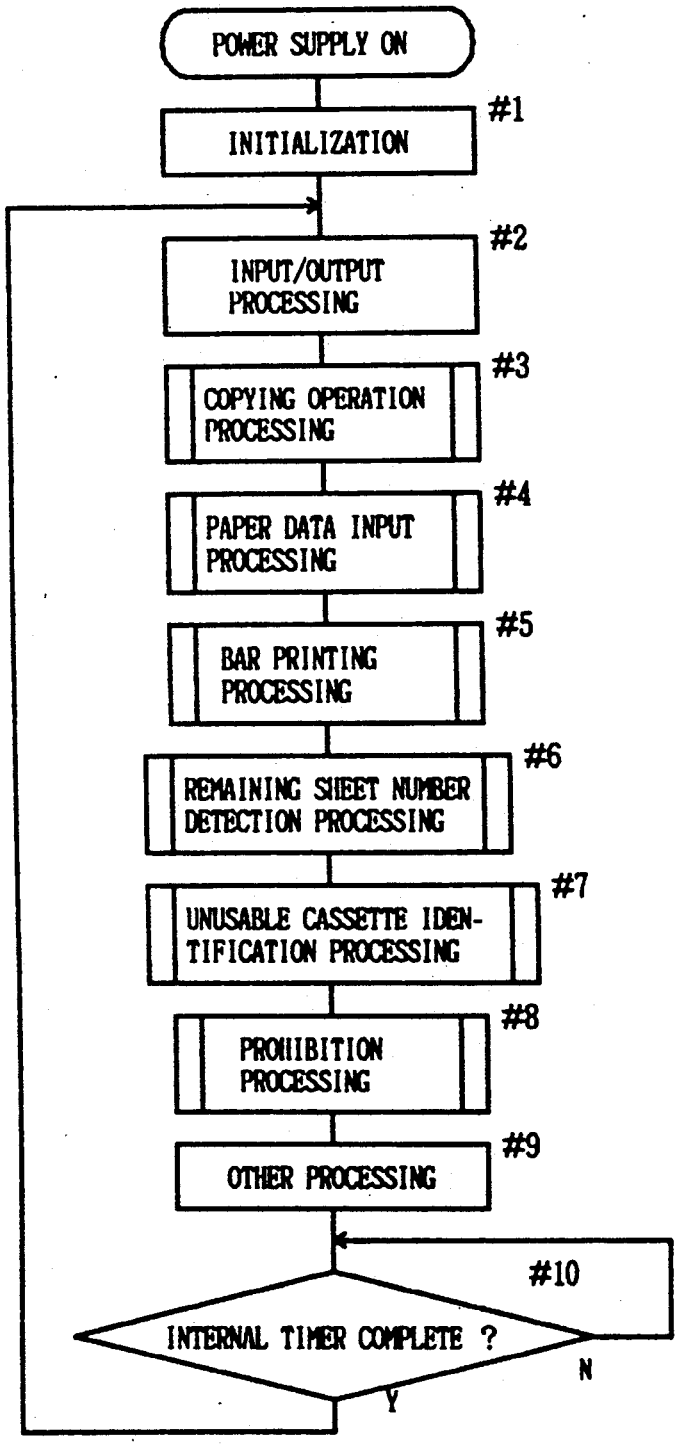
FIG. 13 is a flow chart showing the main routine of a control program.

FIG. 13 is a flow chart showing the main routine, which is started by turning on the power supply. The MPU 40 and the main body 2 are initialized in step #1. Subsequently in step #2, the output and input loads connected to the MPU 40 are controlled.

The sequence then proceeds to the following steps: copying operation processing (step #3), paper data input processing (step #4), bar printing processing (step #5), remaining sheet number detection processing (step #6), unusable cassette identification processing (step #7) and prohibition processing (step #8). These steps will be described later in detail.

Other process including, for example, toner replenishment and display for operation assembly is executed in step #9. Step #10 checks an internal timer (reset and started in step #2) for the completion of its operation, and this step is repeated until the completion of operation, whereupon the sequence returns to step #2. Thus, the time taken for executing one main routine is kept approximately constant. The main routine is performed repeatedly.

Figure 19:
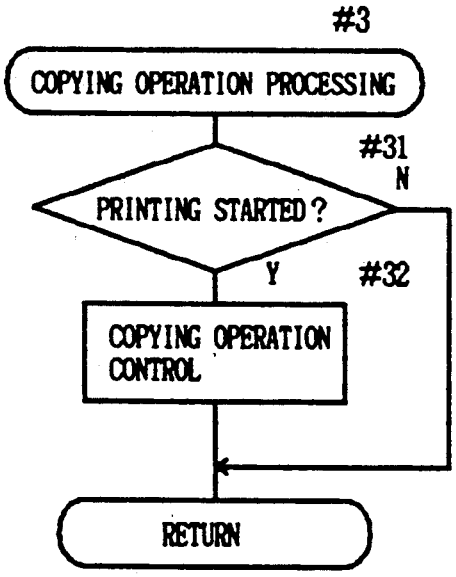
Figure 20:
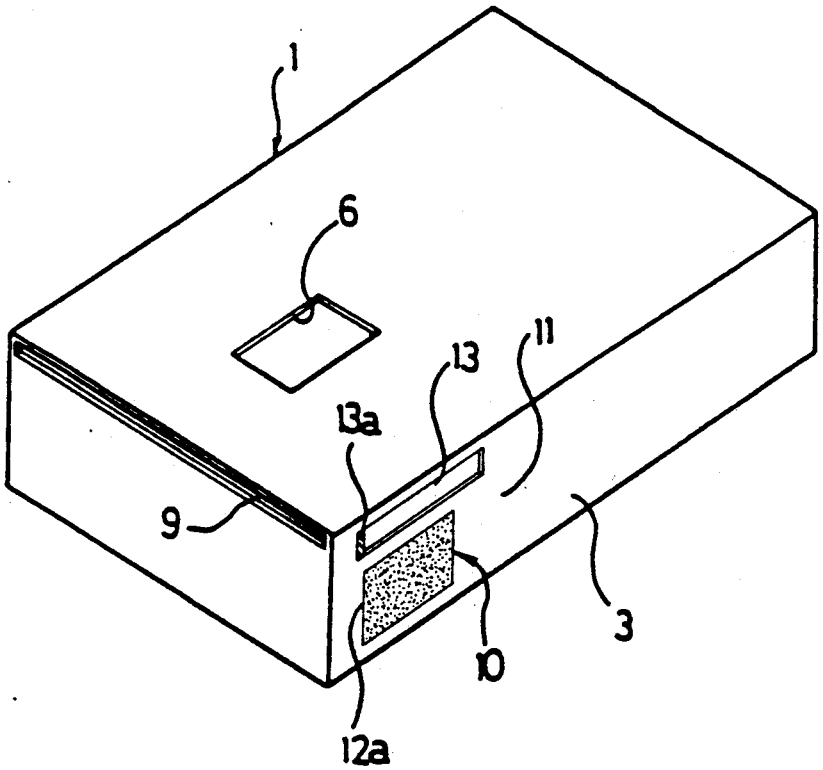
FIG. 20 is perspective view showing the cassette with a magnetic recording indicating member.

The copying operation processing of step #3 is executed according to the subroutine of FIG. 19. Since printing has not been started when the power supply is turned on, the inquiry of step #31 is answered in the negative, and the sequence returns to the main routine without substantial processing. A detailed description will be given later.

Figure 14:
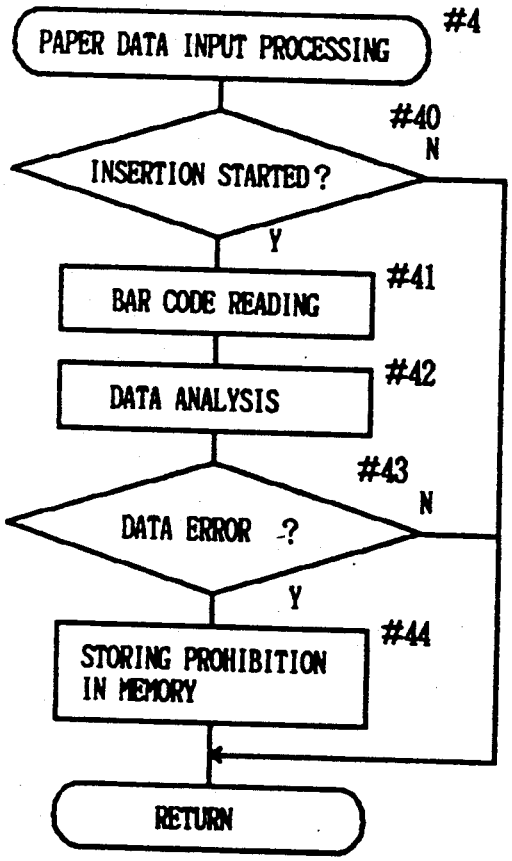
FIGS. 14 to 19 are flow charts showing subroutines of the control program.

The paper data input processing of step #4 is executed with the subroutine of FIG. 14. In this subroutine, the data represented by the bar code is read by the main body 2, and if the data indicates that the cassette is other than the contemplated one, a decision is made to the effect that the cassette should not be used.

Step #40 inquires whether the insertion of the cassette has been started. For this purpose, the reading means 22 is checked as to whether it has detected the forward passage of the front end of the cassette body 3, with reference to the presence or absence of the detection signal. Of course, a special sensor is usable for detecting the start of insertion of the cassette 1.

If the cassette 1 has not been inserted or has already been inserted completely, the inquiry of step #40 is answered in the negative, whereupon the sequence returns to the main routine. The bar code 12 then need not be read, so that paper data input processing is not executed.

Step #40, when answered in the affirmative, is followed by step #41, in which the reading means 22 reads the data of the bar code 12 from bar to bar with the movement of the cassette 1. The data is analyzed in step #42 for the recognition of the characteristics (size, thickness, talc content, quality, etc.) of the paper 5 in the cassette 1 and the number of sheets initially contained therein. The data analyzed is stored in the memory and shown on the displays 163, 166, 167, etc. concerned. Based on the data thus stored, the copying operation processing of step #3 (FIGS. 13 and 19) is performed. In accordance with the paper characteristics, the conditions such as image forming area, charging, transfer, developing bias, exposure and fixing temperature are properly determined for a copying operation (image formation).

When the analysis of the data indicates that the characteristics are other than those contemplated, or if the cassette 1 bears no bar code to be read, step #43 detects an error in data, followed by step #44, in which a decision is made to the effect that no copying (image forming) operation should be conducted. This result is stored in the memory. When step #43 detects no error, the sequence returns to the main routine.

Figure 15:
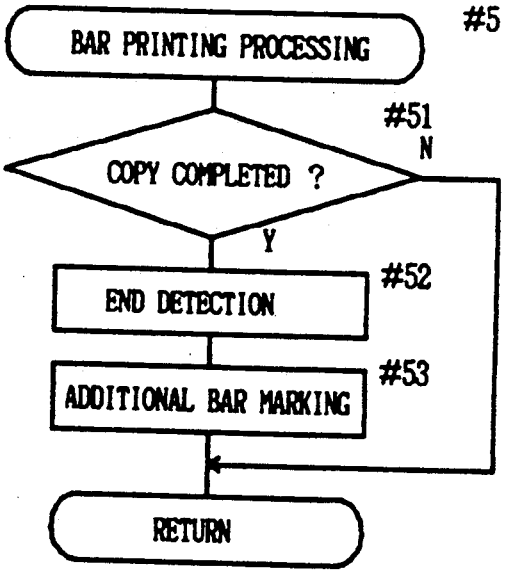

FIG. 15 shows the subroutine of step #5 for the bar printing processing. In this subroutine, a bar portion for the sheet used is added to the black bar 13 on the side surface 11 of the cassette insertion portion 10.

When one sheet of paper 5 is used for copying, step #51 checks whether a copy completion signal has been received. On receipt of the signal, the sequence proceeds to step #52, in which the bar reading means 23 detects the terminal end of the black bar 13. Based on the result, the bar marking means 30 moves to the position of the bar end, where this means additionally marks a length of bar portion corresponding to one sheet used (step #53). The sequence then returns to the main routine. When a new cassette 1 is to be used, the cassette 1 has printed thereon a dummy bar 13*a* for initial position setting, so that the present subroutine can be performed without trouble by detecting the end of this bar. If no copy completion signal is detected in step #51, the sequence returns directly to the main routine.

Figure 16:
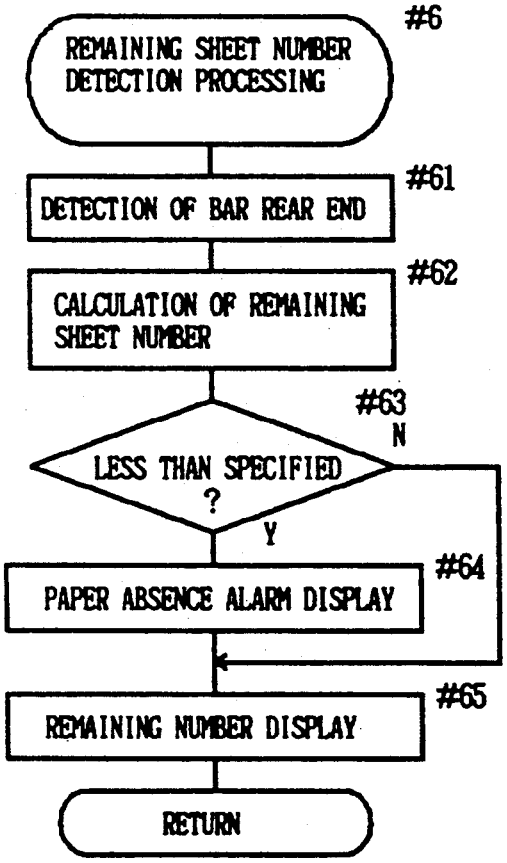

FIG. 16 shows the subroutine of step #6 for the remaining sheet number detection processing. This subroutine is performed for detecting the length of the black bar 13 impressed by the marking means 30, detecting the number of remaining sheets from the detected length, and indicating the result on the display concerned or giving a paper absence alarm.

In step #61, the bar reading means 23 is caused to scan the black bar 13 to detect the rear end of the bar 13. Step #62 calculates the number of sheets used corresponding to the actual length of the bar 13 as determined from the position of the rear end, and compares the number with the initial sheet number already stored in the memory to calculate the number of remaining sheets. The next step #63 checks whether the resulting number is less than a specified number. When the number is less than the specified number, step #64 feeds a display signal to the absence alarm display lamp 164 to turn on the lamp. The sequence then proceeds to step #65. If the remaining sheet number is not less than the specified number, step #63 is immediately followed by step #65.

In step #65, a display signal is given to the remaining sheet number display lamp 163 concerned to show the number. The sequence then returns to the main routine.

Figure 17:
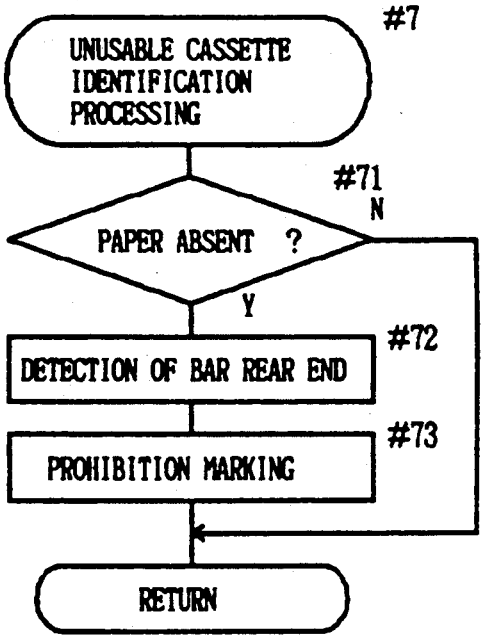

FIG. 17 shows the unusable cassette identification processing subroutine of step #7. When the paper cassette 1 becomes empty, a prohibition mark is made on the cassette to prohibit the use of the cassette in this subroutine.

Step #71 inquires whether the cassette is empty with reference to a signal from the paper absence detecting means 53. If it is not empty, the sequence returns to the main routine. When the cassette is found to be empty in step #71, the terminal end of the black bar 13 already marked is detected by the bar reading means 23 in step #72. In step #73, a bar portion of increased length (use prohibition mark) is added to the detected end by the bar marking means 30. The black bar 13 thus made not smaller than a predetermined length indicates that the cassette bearing the mark is unusable as will be described with reference to step #8. The sequence then returns to the main routine.

Figure 18:
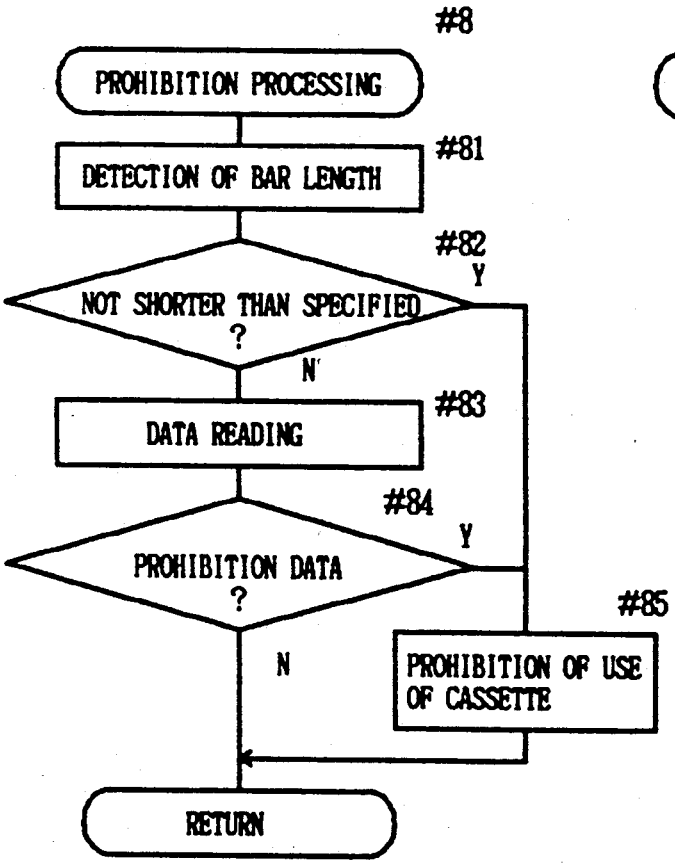

FIG. 18 shows the subroutine of step #8 for prohibiting the use of the cassette. As already stated, the black bar 13 is checked in this subroutine as to whether it is not shorter than the predetermined length to inhibit the reuse of the cassette 1 if it is empty. The subroutine is also intended to prohibit the use of a cassette other than the specified one.

Step #81 detects the length of the black bar 13 by the reading means 23. Next step #82 inquires whether the length is not smaller than the predetermined length. If it is found smaller, step #83 follows, while if otherwise, step #85 follows. In this step #85, a signal for prohibiting copying (image forming) operation is fed to the means 200. Further a display signal is given to the liquid display of the print key 142 to show the paper absence mark. Consequently, the empty cassette 1 is prohibited from use, and this is displayed. The sequence thereafter proceeds to the main routine. Further in step #83, data is read as to whether a cassette other than the specified one is in use (see steps #43 and #44). When step #84 detects that the use of the cassette is prohibited, the use of the cassette is prohibited in step #85. When the cassette in use is a specified one, the sequence returns to the main routine.

As already mentioned, the copying operation processing of step #3 is executed according to the subroutine of FIG. 19. In this subroutine, the image forming conditions are set in conformity with the paper characteristics, such as size, thickness, talc content and quality, based on the data read from the bar code 12.

Step #31 detects the start of printing operation upon receipt of a print start signal from the switch or key on the operation panel or the like. Step #32 then controls the copying operation based on the above data. Thus, control signals are given to the components of the image forming means 200 so that these components operate under conditions suited to the paper characteristics, whereupon they are brought into operation. Consequently, the apparatus operates under proper conditions in respect of the image forming area, charging, transfer, developing bias, exposure, fixing temperature, etc.

While the main image forming conditions have already been described in connection with the description of components, they are summarized as follows.

Paper 5 of increased thickness:
Increase in the temperature of fixing heater 80.
Decrease in fixing pressure of fixing means 77.
Increase in output of transfer charger 72.
Paper 5 of increased electric resistance:
Increase in output of transfer charger 72.
Paper 5 of increased coefficient of friction:
Decrease in feed pressure of feed means 75.
Paper 5 of higher talc content:
Higher d.c. bias voltage for cleaner 73.

Besides the foregoing embodiment, the present invention can be embodied variously. For example, although the bar code 12 is used in the above embodiment for representing the data as to the characteristics of paper 5 in the cassette 1, magnetic or optical record means is usable for representing the data.

While the bar code 12 is shown on the side surface 11 of the insertion portion of the cassette body 3 according to the above embodiment, the code can be provided on some other suitable external portion of the cassette 1.

Although the foregoing embodiment employs code reading means 22 as data reading means, other reading means suited to the mode of representation of the data is usable.

What is claimed is:

1. An image forming apparatus comprising:
means for forming an image on copy paper,
a paper cassette containing the copy paper and removably attached to the main body of the apparatus,
marking means provided in the main body providing a mark on the outer surface of the cassette according to the number of sheets of the copy paper used, said mark being visually discernible when the cassette is attached to and detached from the main body of the apparatus.

2. An apparatus as defined in claim 1 wherein said marking means provides an additional mark at every predetermined number of sheets of the copy paper used at the terminal end of the mark which is detected by the reading means.

3. An apparatus as defined in claim 1 further comprising means for detecting the number of sheets of the copy paper remaining in the cassette based on the data read by the mark reading means.

4. An apparatus as defined in claim 3 further comprising means for displaying the number of sheets of the copy paper remaining in the cassette based on the data from the detecting means.

5. An image forming apparatus comprising:
means for forming an image on copy paper,
a paper cassette containing the copy paper and removably attached to the main body of the apparatus,
marking means provided in the main body providing a mark on the outer surface of the cassette according to the number of sheets of the copy paper used, and
mark reading means provided in the main body for reading the mark, wherein the marking means provides a paper absence mark on the outer surface of the cassette when the copy paper in the cassette has been entirely used.

6. An image forming apparatus comprising:
means for forming an image on copy paper,
a paper cassette containing the copy paper and removably attached to the main body of the apparatus,
marking means provided in the main body providing a mark on the outer surface of the cassette according to the number of sheets of the copy paper used,
mark reading means provided in the main body for reading the mark, wherein said marking means provides a paper absence mark on the outer surface of the cassette when the copy paper in the cassette has been entirely used, and
means for prohibiting the operation of the image forming means upon the mark reading means reading the paper absence mark.

7. An image forming apparatus comprising:
means for forming an image on copy paper;
a paper cassette containing the copy paper and removably attached to the main body of the apparatus;
data representing portion provided on the outer surface of the cassette and representing data as to the copy paper contained in the cassette;
data reading means provided in the main body for reading the data;
judging means for determining whether the operation of the image forming means is to be prohibited based on the data obtained by the data reading means; and
control means for controlling the image forming means based on the data obtained by the reading means when said judging means determines that the operation of the image forming means is not prohibited.

8. An apparatus as defined in claim 7 wherein the data includes at least one of the thickness, talc content and quality of the copy paper.

9. An apparatus as defined in claim 7 wherein the image forming means includes a rotatable photosensitive member, means for forming a toner image on the photosensitive member and a transfer charger for transferring the toner image from the photosensitive member onto the copy paper, and the control means controls the output of the transfer charger based on the data.

10. An apparatus as defined in claim 7 wherein the image forming means includes means for forming a toner image on a photosensitive member, a transfer charger for transferring the toner image from the photosensitive member onto the copy paper and fixing means for fixing the toner image to the copy paper, and the control means controls the power supply to a fixing heater included in the fixing means based on the data.

11. An apparatus as defined in claim 7 wherein the image forming means includes means for forming a toner image on a photosensitive member, a transfer charger for transferring the toner image from the photosensitive member onto the copy paper and fixing means comprising fixing rollers for fixing the toner image to the copy paper, and the control means controls the pressure between the fixing rollers based on the data.

12. An apparatus as defined in claim 7 wherein the image forming means includes a feed roller for feeding the copy paper from the interior of the cassette to the main body, and the control means controls the feed pressure between the feed roller and the copy paper based on the data.

13. An apparatus as defined in claim 7 wherein the image forming means includes a rotatable photosensitive member, means for forming a toner image on the photosensitive member and a cleaner for removing toner from the photosensitive member, and the control means controls the d.c. bias voltage to be applied to the cleaner, based on the data.

14. An apparatus as defined in claim 7 wherein the data representing means is a bar code.

15. An apparatus as defined in claim 7 wherein the data representing means is a magnetic recording-indicating member.

16. An apparatus as defined in claim 7 wherein the data reading means is fixedly provided in the main body for reading the data with the attaching movement of the cassette.

17. An image forming apparatus comprising:

a paper cassette containing copy paper and removably attached to the main body of the apparatus;

means for forming an image on the copy paper, said image forming means including a rotatably photosensitive member, means for forming a toner image on the photosensitive member, means for transferring a toner image from the photosensitive member onto the copy paper, means for feeding the copy paper from the interior of the cassette towards the transfer means and means for fixing the toner image to the copy paper;

data representing portion provided on the outer surface of the cassette and representing data as to the copy paper contained in the cassette;

data reading means fixedly provided in the main body for reading the data during the attaching movement of the cassette, transmission of data being terminated subsequent to movement of the cassette; and control means for controlling at least two means of said image forming means in complemental relation to each other based on the data obtained by the reading means.

18. An apparatus as defined in claim 17, wherein said data representing portion is a bar code.

19. An apparatus as defined in claim 17, wherein said data representing portion is a magnetic recording-indicating member.

20. An apparatus as defined in claim 17, wherein said data reading means includes a single detector for reading the data during the attaching movement of the cassette.

21. An apparatus as defined in claim 20, wherein said data reading means includes a light emitting element for illuminating said data representing portion, said detector detecting the light reflected from said data representing portion.

22. An image forming apparatus comprising:

means for forming an image on copy paper;

a paper cassette containing the copy paper and removably attached to the main body of the apparatus;

data representing portion provided on the outer surface of the cassette and extending lengthwise in a predetermined direction, said data representing portion representing data as to the copy paper contained in the cassette;

data reading means fixedly provided in the main body for reading the data during the attaching movement of the cassette in said predetermined direction, transmission of data being terminated subsequent to movement of the cassette; and control means for controlling the image forming means based on the data obtained by the reading means.

23. An apparatus as defined in claim 22, wherein said data reading means is movable in the predetermined direction.

24. An apparatus as defined in claim 22, wherein said data representing portion is a bar code.

25. An apparatus as defined in claim 22, wherein said data representing portion is a magnetic recording-indicating member.

26. An apparatus as claimed in claim 22, wherein said data reading means includes a single detector for reading the data during the attaching movement of the cassette.

27. An apparatus as defined in claim 26, wherein said data reading means includes a light emitting element for illuminating the data representing portion, said detector detecting the light reflected from said data represented portion.

* * * * *